US008621775B2

(12) United States Patent
Troy

(10) Patent No.: US 8,621,775 B2
(45) Date of Patent: Jan. 7, 2014

(54) FIREARM SIGHT WITH DUAL DIAMOND SHAPED APERTURES

(76) Inventor: Stephen P. Troy, Lee, MA (US)

( * ) Notice: Subject to any disclaimer, the term of this patent is extended or adjusted under 35 U.S.C. 154(b) by 34 days.

(21) Appl. No.: 13/153,093

(22) Filed: Jun. 3, 2011

(65) Prior Publication Data

US 2011/0296734 A1 Dec. 8, 2011

Related U.S. Application Data

(60) Provisional application No. 61/351,456, filed on Jun. 4, 2010.

(51) Int. Cl.
*F41G 1/10* (2006.01)

(52) U.S. Cl.
USPC ..... 42/140; 42/141

(58) Field of Classification Search
USPC ..... 42/140–141
See application file for complete search history.

(56) References Cited

U.S. PATENT DOCUMENTS

| | | | | |
|---|---|---|---|---|
| 264,899 | A | 9/1882 | Prior | |
| 830,442 | A * | 9/1906 | King | 42/140 |
| 861,652 | A * | 7/1907 | Hawkins | 42/136 |
| 1,027,892 | A * | 5/1912 | Peck | 42/140 |
| 1,365,236 | A * | 1/1921 | Fletcher et al. | 42/140 |
| 1,466,913 | A * | 9/1923 | Matthews | 42/140 |
| 2,331,903 | A | 10/1943 | Garand | |
| 3,568,324 | A * | 3/1971 | Jorczak | 42/142 |
| 7,356,962 | B2 * | 4/2008 | Swan | 42/147 |
| 8,015,744 | B1 * | 9/2011 | Swan | 42/147 |
| 8,069,607 | B2 * | 12/2011 | Ballard | 42/140 |
| 2008/0276520 | A1 | 11/2008 | Ballard | |
| 2009/0071056 | A1 * | 3/2009 | Storch et al. | 42/137 |
| 2009/0188147 | A1 * | 7/2009 | Schwerman et al. | 42/148 |

* cited by examiner

*Primary Examiner* — Michael David
(74) *Attorney, Agent, or Firm* — Parsons & Goltry; Robert A. Parsons; Michael W. Goltry

(57) ABSTRACT

A sight for use on a firearm includes a frame member mountable to a firearm and having a pair of spaced apart posts extending therefrom, a support member extending transversely between the pair of posts and selectively rotatable with respect thereto, and a sight element. The sight element is carried by the support member between the posts and includes a central portion rotatably coupled to the support member, a first sight aperture portion extending from the central portion and defining a first aperture formed in a diamond shape with an upper v-notch and a lower v-notch, and a second sight aperture portion extending from the central portion and defining a second aperture formed in a diamond shape.

4 Claims, 3 Drawing Sheets

FIREARM SIGHT WITH DUAL DIAMOND SHAPED APERTURES

CROSS-REFERENCE TO RELATED APPLICATION

This application claims the benefit of U.S. Provisional Application No. 61/351,456, filed 4 Jun. 2010.

FIELD OF THE INVENTION

This invention relates to firearm accessories.

More particularly, the present invention relates to sights for firearms.

BACKGROUND OF THE INVENTION

In the field of firearms, sights are numerous and varied but are used for a single purpose. A sight system is intended to put a bullet on a target. Sight systems include, in a basic form, a rear sight and a front sight. Lining up the front sight with the rear sight is intended to determine the striking position of the bullet. However, there are added factors complicating this simple process. The distance the bullet must travel will cause a deviation from the designated target. In other words, a front and rear sight can be adjusted to deliver bullet on target at a specific distance. A greater distance will result in a low bullet strike. This deviation can be accounted for by adjusting the front or rear sight relative the other. However, adjustable sights require that the sight be tested as adjusted to determine the appropriate amount of adjustment.

It would be highly advantageous, therefore, to remedy the foregoing and other deficiencies inherent in the prior art by having pre-set sight distances.

SUMMARY OF THE INVENTION

Briefly, to achieve the desired objects and advantages of the instant invention, provided is a sight for a firearm. The sight for use on a firearm includes a frame member mountable to a firearm and having a pair of spaced apart posts extending therefrom, a support member extending transversely between the pair of posts and selectively rotatable with respect thereto, and a sight element. The sight element is carried by the support member between the posts. The sight element includes a central portion rotatably coupled to the support member, a first sight aperture portion extending from the central portion and defining a first aperture formed in a diamond shape with an upper v-notch and a lower v-notch, and a second sight aperture portion extending from the central portion and defining a second aperture formed in a diamond shape.

In a specific aspect, the sight element is constrained from lateral movement along the support member. Furthermore, the support member extends through one of the pair of posts and terminating in a knob to facilitate rotation of the support member with respect to the pair of posts such that the support member can be moved longitudinally between the pair of posts, coincidentally moving the sight element and allowing minute of angle adjustment.

In another aspect, a rear sight for a firearm is provided. The rear sight includes a mounting base, a frame member having an end pivotally coupled to the base and an opposing end, a pair of spaced apart posts extend from the opposing end of the frame member, a support member extending transversely between the pair of posts and selectively rotatable with respect thereto, and a sight element carried by the support member between the posts. The sight element includes a central portion, a first sight aperture portion extending from the central portion and defining a first aperture formed in a diamond shape with an upper v-notch and a lower v-notch, and a second sight aperture portion extending from the central portion and defining a second aperture formed in a diamond shape being smaller than the first aperture.

In yet another aspect, a sight for use with a firearm is provided, including a sight element. The sight element includes a central portion, a first sight aperture portion extending from the central portion and defining a first aperture formed in a diamond shape with an upper v-notch and a lower v-notch, and a second sight aperture portion extending from the central portion and defining a second aperture formed in a diamond shape.

BRIEF DESCRIPTION OF THE DRAWINGS

Specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENTS

Figure 1:
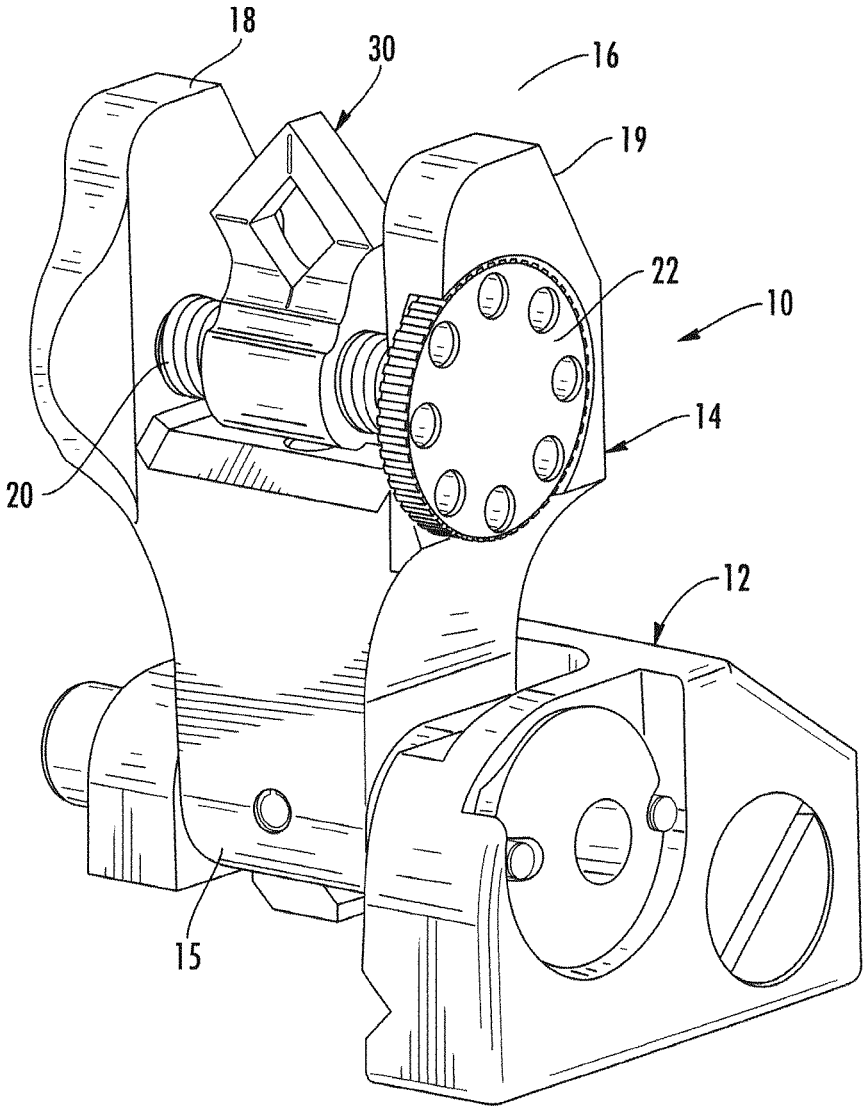
FIG. 1 is a perspective view of a rear sight in a first configuration, according to the resent invention.
Figure 2:
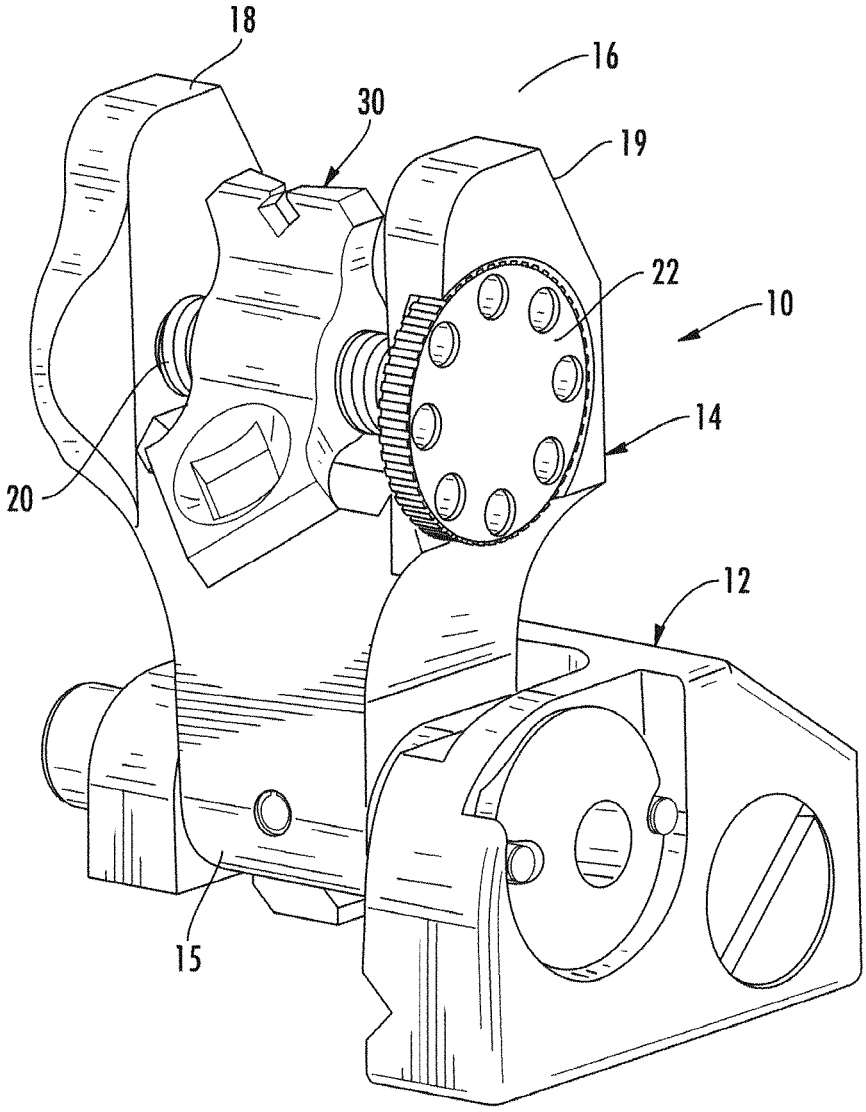
FIG. 2 is a perspective view of the rear sight of FIG. 1 in a second configuration, according to the present invention.

Turning now to the drawings in which like reference characters indicate corresponding elements throughout the several views, attention is first directed to FIGS. 1 and 2 which illustrates a rear sight for use on a firearm, generally designated 10. Rear sight 10 is couplable to, or proximate, the receiver of a firearm and is used in combination with a front sight. Sight 10, in the present embodiment includes an attachment base 12 configured to be received by and secured to a rail of a firearm. One of ordinary skill in the art will understand that the rail can be attached to or be a part of the receiver of a firearm, or can be a part of or attached to a handguard carried by the firearm. It will also be understood that a fixed or integral base can also be employed.

A pivoting frame member 14 includes an end 15 pivotally coupled to base 12 and an opposing end 16. Frame member 14 is moveable between an upright position (illustrated) in which sight 10 is configured for use, and a lowered position for storage. Opposing end 16 includes spaced apart posts 18 and 19 extending therefrom. When support member 14 is in the upright position, posts 18 and 19 extend upwardly. Frame member 14 includes a support member 20 extending transversely between posts 18 and 19 and is selectively rotatable with respect thereto. An end of support member 20 extends through post 19 and terminates in a knob 22. Knob 22 facilitates rotation of support member 20 with respect to posts 18 and 19.

Figure 3:
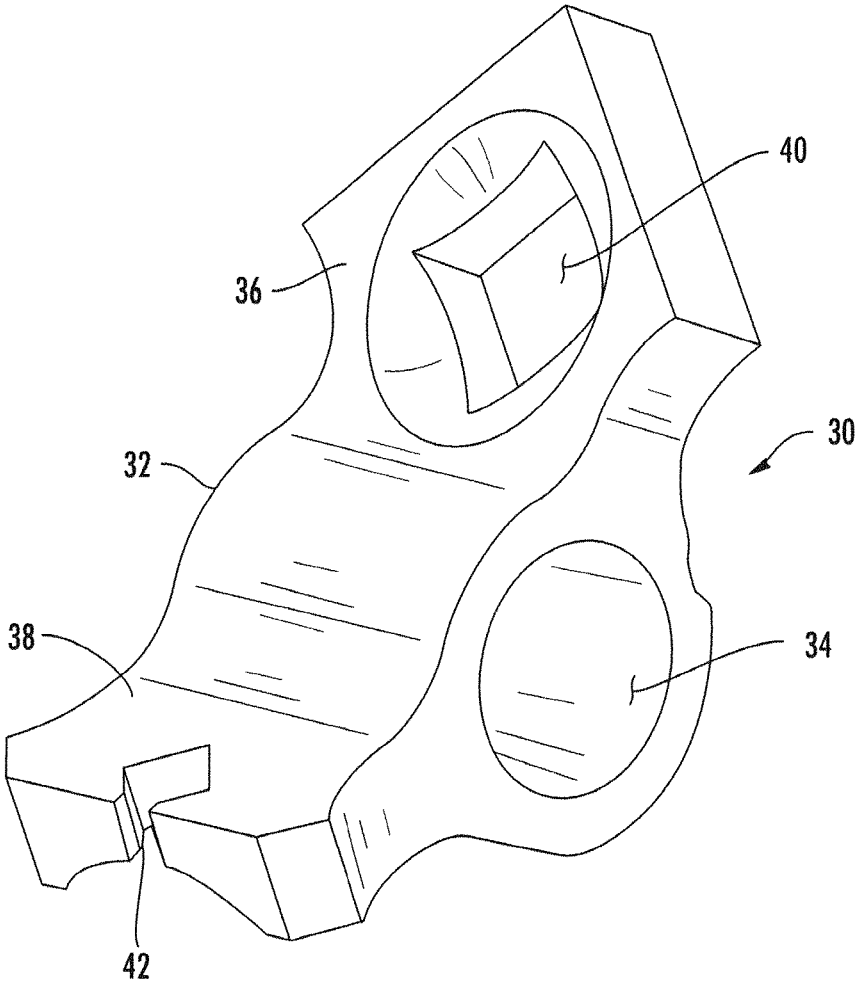
FIG. 3 is a perspective view of a sight element of FIGS. 1 and 2.

With additional reference to FIG. 3, a sight element 30 is carried by support member 20 and positioned so as to be substantially centrally located between posts 18 and 19. Sight element 30 includes a central portion 32 with a transverse opening 34, a sight aperture portion 36 extending from central portion 32 and a sight aperture portion 38 extending from central portion 32 opposite sight aperture portion 36. Sight aperture portion 36 includes an aperture 40 formed therethrough, and sight aperture 38 has an aperture or notch 42 formed therethrough. Sight aperture portion 36 and sight aperture portion 38 are at a 135 degree angle with respect to each other in the preferred embodiment. Sight element 30 is constrained from lateral movement along support member 20, generally fixed in the center thereof, but rotatable thereon between two positions. Lateral movement of sight element 30 is constrained with respect to support member 20 so that longitudinal movement of support member 20 between posts 18 and 19 controllably and reproducibly adjusts the position of sight element 30 relative posts 18 and 19. Rotational movement of sight element 30 with respect to support member 20 is between a position wherein sight aperture portion 36 is upright (FIG. 1), and a position wherein sight aperture portion 38 is upright (FIG. 2).

Aperture 40 is preferably formed in a diamond shape with an upper v-notch and a lower v-notch. The upper and lower notches can be used as sighting locations each having specific ranges. The center of aperture 40 can be another sighting distance that has been pre-calibrated. Thus, with sight aperture portion 36 in the upright position, multiple sighting indexes can be provided. By using knob 22, support member 20 can be moved longitudinally between posts 18 and 19, coincidentally moving sight element 30 and allowing minute of angle adjustment. Knob 22 preferably includes incremental movements referred to as "clicks". Preferably, each incremental "click" is in increments of 0.50 minutes of angle. Additionally, sight element 30 can be rotated on support member 20 to place sight aperture portion 38 in the upright position. Aperture 42 then functions as the sight aperture. In this embodiment, aperture 42 is also diamond shaped, but has smaller dimensions to facilitate sighting on targets at a greater distance away. The top v-notch in this instance can be open to facilitate target acquisition at the greater ranges. Thus aperture 42 has sighting distances that have been pre-calibrated. By employing rear sight 10, multiple sight options are available for distances over a large range without requiring incremental adjustment of the sight.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A sight for a firearm, comprising:

a frame member mountable to a firearm and having a pair of spaced apart posts extending therefrom;

a support member extending transversely between the pair of posts and selectively rotatable with respect thereto; and a sight element carried by the support member between the posts, the sight element including:

a central portion rotatably coupled to the support member;

a first sight aperture portion extending from the central portion and defining a first aperture formed in a diamond shape with an upper v-notch indexed to a first distance and a lower v-notch indexed to a second distance; and a second sight aperture portion extending from the central portion and defining a second aperture formed in a diamond shape, wherein the second aperture formed in a diamond shape is smaller than the first aperture and includes an open top to the second aperture.

2. The sight for a firearm as claimed in claim 1 wherein the sight element carried by the support member between the posts is moveable between a position wherein the first sight aperture portion is upright, and a position wherein the second sight aperture portion is upright.

3. The sight for a firearm as claimed in claim 1 wherein the sight element is constrained from lateral movement along the support member.

4. The sight for a firearm as claimed in claim 3 further comprising an end of the support member extending through one of the pair of posts and terminating in a knob to facilitate rotation of the support member with respect to the pair of posts such that the support member can be moved longitudinally between the pair of posts, coincidentally moving the sight element and allowing minute of angle adjustment.

* * * * *